US006374792B1

(12) United States Patent
Suzuki et al.

(10) Patent No.: US 6,374,792 B1
(45) Date of Patent: Apr. 23, 2002

(54) ENGINE DECOMPRESSION DEVICE

(75) Inventors: Hiroyuki Suzuki; Kenji Yukishima, both of Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/498,517

(22) Filed: Feb. 4, 2000

(30) Foreign Application Priority Data

Feb. 4, 1999 (JP) ..... 11-026989

(51) Int. Cl.[7] ..... F01L 13/08
(52) U.S. Cl. ..... 123/182.1
(58) Field of Search ..... 123/182.1, 195 P, 123/195 HC

(56) References Cited

U.S. PATENT DOCUMENTS 2,530,623 A * 11/1950 Martin ..... 123/185.3
4,453,507 A * 6/1984 Braun et al. ..... 123/182.1
4,570,584 A * 2/1986 Uetsuji et al. ..... 123/195 C
5,150,674 A * 9/1992 Gracyalny ..... 123/182.1
5,816,208 A 10/1998 Kimura ..... 123/182.1

* cited by examiner

*Primary Examiner*—Andrew M. Dolinar
(74) *Attorney, Agent, or Firm*—Knobbe, Martens, Olson & Bear, LLP

(57) ABSTRACT

An engine decompression device includes an improved construction to release at an exceedingly slow engine speed. The engine has a camshaft that actuates at least one exhaust valve and extends generally vertically. The decompression device has an actuator mounted on the camshaft for pivotal movement about a pivot axis extending generally normal to an axis of the camshaft. The actuator includes a cam section that holds the exhaust valve in an open position and a sinker section that moves with centrifugal force produced by relatively slow rotation of the camshaft so as to release the cam section from holding the exhaust valve open.

33 Claims, 7 Drawing Sheets

ENGINE DECOMPRESSION DEVICE

PRIORITY INFORMATION

The present application is based upon and claims priority to Japanese Patent Application No. Hei 11-026989, filed Feb. 4, 1999, the entire contents of which is hereby expressly incorporated by reference.

BACKGROUND OF THE INVENTION

1. Field of the Invention

This invention relates to an engine decompression device, and more particularly to an improved decompression device that is suitable for marine engines.

2. Description of Related Art

In many engine applications, the operator may be required to manually start an internal combustion engine. This may be true whether or not the engine is also provided with an electrical or otherwise operated self-starting mechanism. For instance, it is frequently the practice in outboard motors, and particularly those of small displacement, to incorporate a mechanism whereby the engine may be manually started. This is normally done by a rope or recoil starter mechanism that is associated with a flywheel on the upper end of the crankshaft.

However, in order to achieve good engine performance, it is also the practice to use relatively high compression ratios. The use of such high compression ratios gives rise to a rather large force that must be overcome by the operator to effect manual starting. There have been, therefore, proposed types of decompression devices which effectively lower the compression ratio of the engine during the manual starting procedure. Preferably, such devices should be operative so as to be automatic in nature wherein the compression ratio is lowered only long enough to facilitate starting and not long enough to interfere with the running of the engine once starting has been accomplished. That is, the decompression device must be released promptly when engine is started and not work above a selected idle engine speed. One of the proposed devices has a construction in which a decompression actuator is mounted on a camshaft for pivotal movement about a pivot axis extending generally normal to an axis of the camshaft. The actuator has a cam section which may hold directly or indirectly an exhaust valve of the engine in an open position, and a weight section or sinker section which has a weight or sinker and may move with centrifugal force produced by rotation of the camshaft so as to release the cam section from holding the exhaust valve in the open position. An example of such a device is disclosed in U.S. Pat. No. 5,816,208.

Such a decompression device is, of course, applicable to an engine which powers a marine propulsion device provided in an outboard motor. However, some problems are caused by this particular use and a special structure of the engine for the outboard motor. That is, the engine for the outboard motor is often used under a trolling condition that drives an associated watercraft very slowly. Since a trolling speed almost equals to an idle speed of the particular engine and is quite slow, it is necessary to decrease an engine speed at which the decompression device is released to the speed that is lower than the trolling or idle speed. This is extremely difficult. If, however, the releasing speed is not stable under the trolling speed, an engine stall is quite likely to occur during the trolling operation.

Meanwhile, the camshaft of the engine for the outboard motor extends generally vertically and is driven by the crankshaft which also extends generally vertically. This particular construction consequently results in the sinker on the decompression device being significantly influenced by gravity and, therefore, adds another problem: the center of gravity in the decompression actuator must be determined by carefully selecting a proper weight for and a position of the sinker in consideration of the influence of gravity so that the decompression actuator will release at a slow rotational speed.

In addition, due to a relatively small and restricted space between an intake valve and an exhaust valve, the decompression actuator usually cannot be disposed therebetween in outboard motor engines. Thus, the actuator often is placed above an exhaust valve if the exhaust valve is disposed above the intake valve, or placed below an exhaust valve if the exhaust valve is disposed below the intake valve.

In the prior construction, the cam section is placed lower than the pivot axis of the actuator and primarily positioned close to the exhaust valve because of gravity. Accordingly, the releasing speed of the decompression actuator can be determined based only upon centrifugal force exerted on the cam section. That is, the sinker section is not always needed and thus merely provided to adjust the releasing speed minutely. It is, therefore, relatively easier to release the cam section in the aimed slow engine speed.

However, it is complicated and difficult to release the actuator properly in the latter construction, because the cam section is placed upper than the pivot axis of the actuator. This means that the cam section will depart from the exhaust valve unless the sinker section has much weight or the length from the pivot axis to the sinker is much longer. The fact is apparently inconsistent with the requirement that the sinker must move promptly with a relatively small centrifugal force to release the cam section in an aimed slow engine speed.

SUMMARY OF THE INVENTION

A need, therefore, exists for an improved decompression device that can be released at an exceedingly slow engine speed. A further need exists for the device in which weight and a position of a sinker are relatively easily selected.

In accordance with one aspect of the present invention, an internal combustion engine comprises a cylinder block defining at least one cylinder bore therein. A crankshaft is journaled for rotation relative to the cylinder block at one end of the cylinder bore and driven by a piston reciprocating in the cylinder bore. A cylinder head closes the other end of the cylinder bore and defines a combustion chamber with the piston and the cylinder bore. An intake passage communicates with the combustion chamber through a valve port. An intake valve is provided for regulating flow through the valve port. An exhaust passage extends from an exhaust port in the combustion chamber for discharging exhaust products from the combustion chamber. An exhaust valve is provided for regulating flow through the exhaust port. A camshaft rotates about a camshaft axis and is driven in timed relationship with the crankshaft to actuate at least the intake valve or the exhaust valve. A decompression device is provided to at least partially open the intake or exhaust valve at least during a portion of the compression stroke to reduce the compression ratio of the combustion chamber to ease manual starting of the engine. The decompression device includes an actuator mounted on the camshaft for pivotal movement about a pivot axis that extends generally normal to the camshaft axis. The actuator has a first section to hold the intake or exhaust valve at least partially open when the actuator is placed at an initial position. The actuator also has a second section disposed opposite the first section relative to the pivot axis.

The actuator is configured such that its center of gravity is located away from the pivot axis by a sufficient distance d so as to cause a rotational moment of the actuator to be greater than a minimum moment necessary for the actuator to return to the initial position under its own weight. The center of gravity of the actuator also is located relative to the pivot axis such a displacement angle $\theta_g$ is generally less than a marginal angle $\theta_m$. The displacement angle $\theta_g$ is defined between a line, which extends through the pivot axis and the center of gravity, and a datum line, which extends through the pivot axis and lies generally parallel to the camshaft axis. This displacement angle $\theta_g$ represents the angle at which the center of gravity lies away from the datum line along an arc defined by distance d. The marginal angle $\theta_m$ corresponds to a maximum angle at which the center of gravity can be moved away from the datum line along the arc defined to by distance d and still have the actuator release from the initial position at a preset minimum rotational speed of the camshaft.

In accordance with another aspect of the present invention, an engine comprising a camshaft for activating at least one intake or exhaust valve. The camshaft is rotatable about a camshaft axis. A decompression device comprises an actuator that is mounted on the camshaft for pivotal movement about a pivot axis which extends generally normal to the camshaft axis. The actuator includes a cam section, which holds the intake or exhaust valve in at least a partially open position, and a sinker section that moves with centrifugal force produced by rotation of the camshaft so as to release the cam section from holding the intake or exhaust valve at least partially open. The cam section is disposed on one side of the actuator relative to the pivot axis and the sinker section is disposed on an opposite side of the actuator relative to the pivot axis. The actuator is configured such that is center of gravity lies to the same side of the pivot axis as does the sinker section.

Further aspects, features and advantages of this invention will become apparent from the detailed description of the preferred embodiments which follow.

BRIEF DESCRIPTION OF THE DRAWINGS

These and other features of this invention will now be described with reference to the drawings of a preferred embodiment which is intended to illustrate and not to limit the invention.

DETAILED DESCRIPTION OF THE PREFERRED EMBODIMENT OF THE INVENTION

Figure 1:
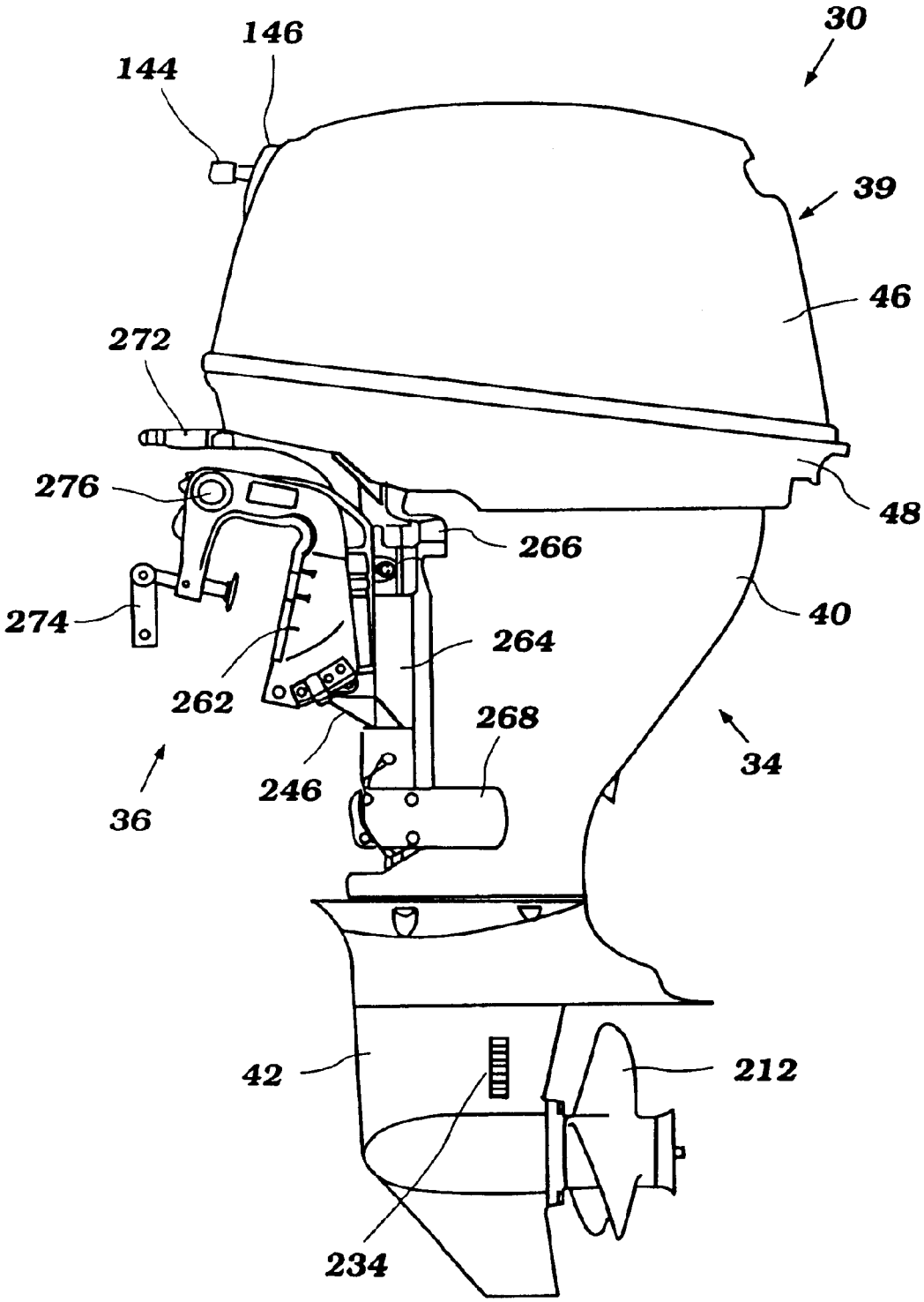
FIG. 1 is a side elevational view showing an outboard motor that employs an engine including decompression devices in accordance with a preferred embodiment of the present invention.

With reference to FIGS. 1 to 5, an outboard motor, designated generally by the reference numeral 30, includes an internal combustion engine 32 arranged in accordance with a preferred embodiment of this invention. Although the present invention is shown in the context of an engine for an outboard motor, various aspects and features of the present invention also can be employed with other types of engines used for such as, for example, a marine stern drive systems and land vehicles.

In the illustrated embodiment, the outboard motor 30 comprises a drive unit 34 and a bracket assembly 36. The drive unit 34 can be affixed to a transom of an associated watercraft by the bracket assembly 36.

The drive unit 34 includes a power head 39, a driveshaft housing 40 and a lower unit 42. The power head 39 is disposed atop of the drive unit 34 and includes the engine 32, a top protective cowling 46 and a bottom protective cowling 48.

Figure 4:
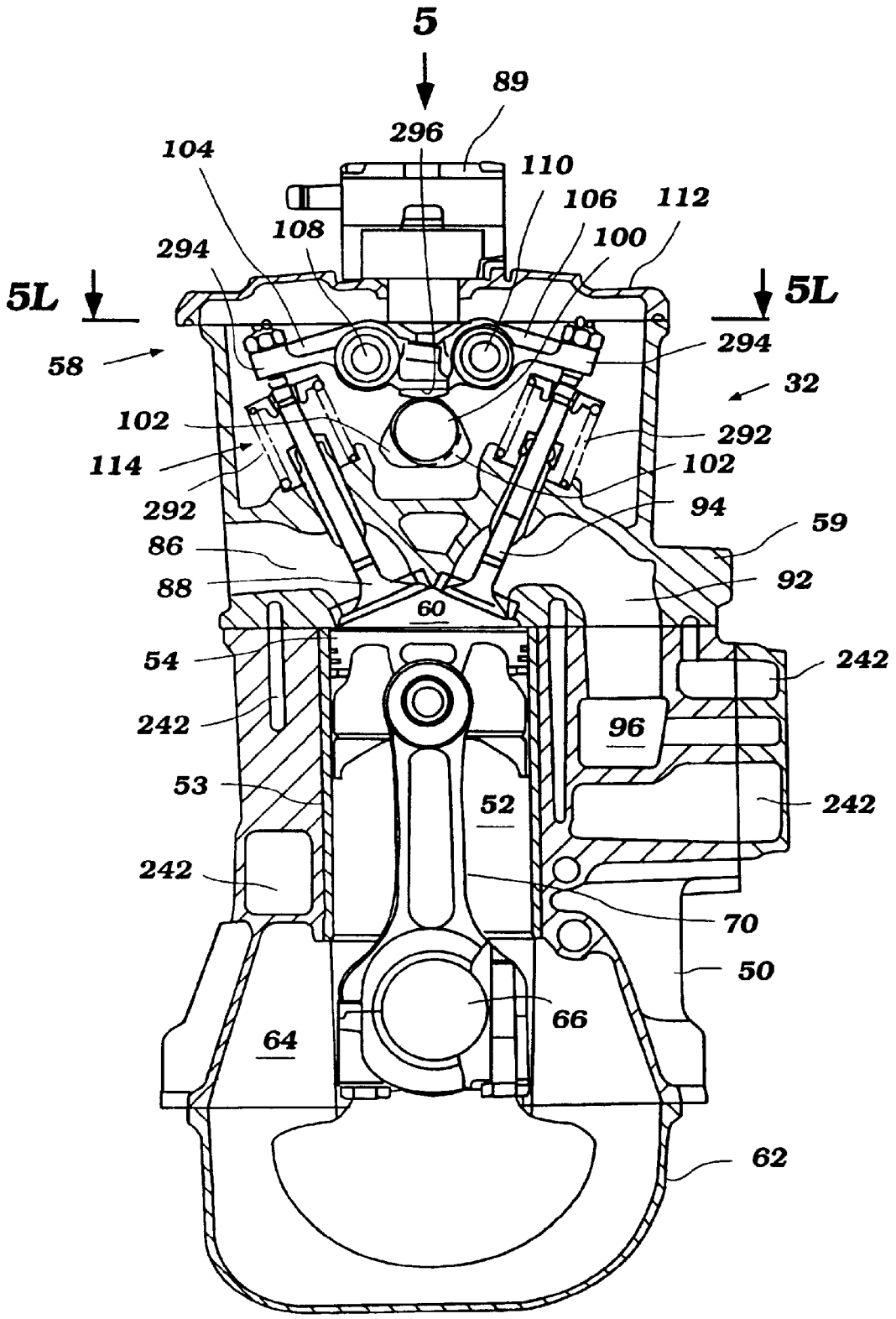
FIG. 4 is a cross-sectional view of the engine taken along the line 4—4 in FIG. 2.

The engine 32 operates on a four stroke cycle principle and powers a propulsion device. As best seen in FIG. 4, the engine 32 has a cylinder block 50. The cylinder block 50 defines two cylinder bores 52 generally horizontally extending and spaced generally vertically with each other. The engine, of course, can include other numbers of cylinders and can have other cylinder orientations and arrangements (e.g., V-type).

A cylinder liner 53 is inserted within each cylinder bore 52. The term "cylinder bore" means a surface of this cylinder liner 53 in this description. A piston 54 reciprocates in each cylinder bore 52. A cylinder head assembly 58, more specifically a cylinder head member 59, is affixed to one end of the cylinder block 50 and defines two combustion chambers 60 with the pistons 54 and the cylinder bores 52. The other end of the cylinder block 50 is closed with a crankcase member 62 defining a crankcase chamber 64 with the cylinder bores 52.

A crankshaft 66 is journaled for rotation relative to the cylinder block 50 and extends generally vertically through the crankcase chamber 64. The crankshaft 66 is pivotally connected with the pistons 54 by connecting rods 70 and rotates with the reciprocal movement of the pistons 54. The crankcase member 64 is located at the most forward position, then the cylinder block 50 and the cylinder head assembly 58 extend rearwardly from the crankcase member 62 one after the other.

Figure 3:
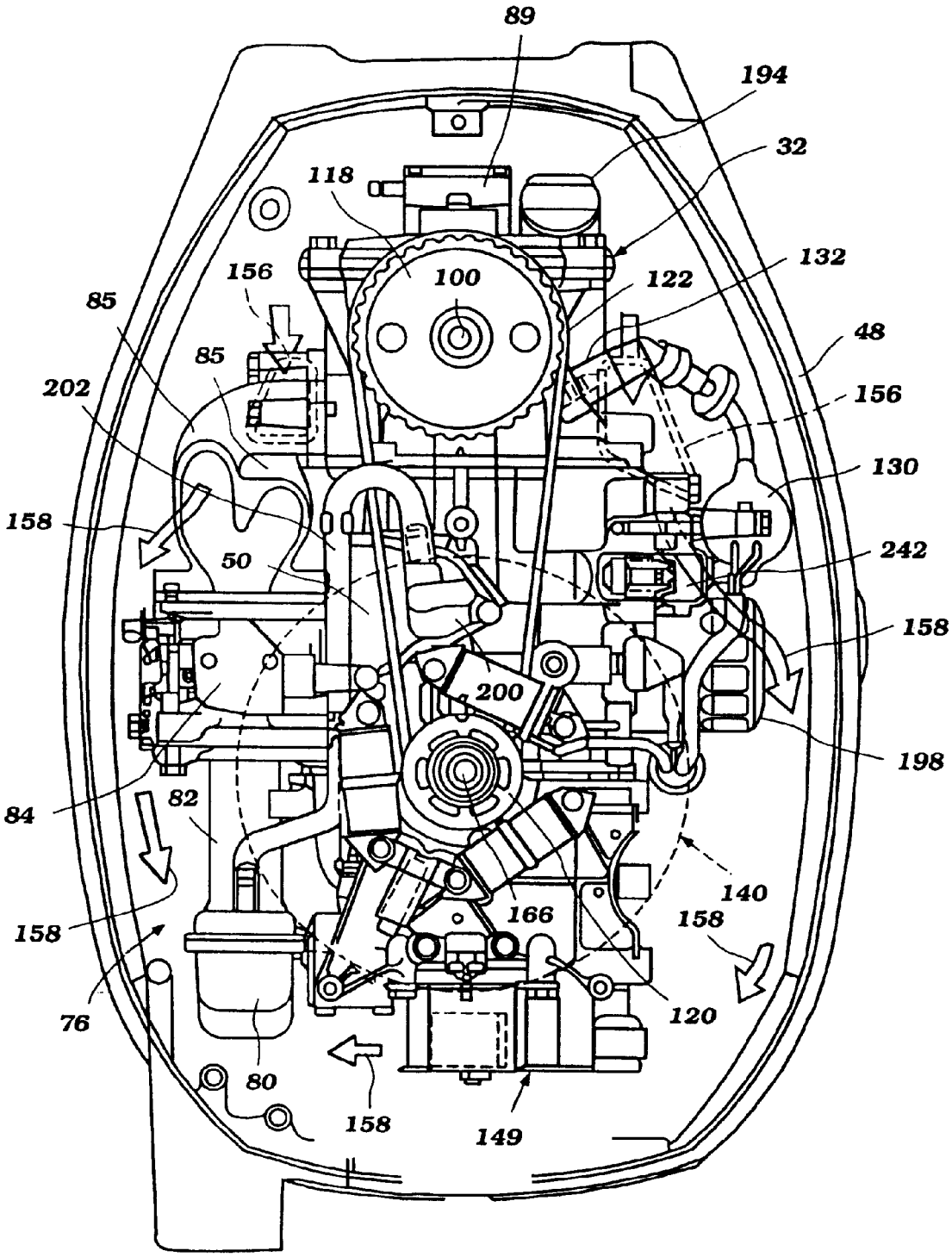
FIG. 3 is a top plan view showing the outboard motor of FIG. 1 with a top protective cowling and a flywheel removed.

The engine 32 includes an air induction system 76 and exhaust system 78. As best seen in FIG. 3, the air induction system 76 is arranged to supply air charges to the combustion chambers 60 and comprises an air intake chamber or intake silencer 80, an intake manifold 82, carburetors 84, intake runners 85 and intake ports 86 (see FIG. 4). The intake ports 86 are opened or closed by intake valves 88. When the intake ports 86 are opened, the air induction system 76 communicate with the combustion chambers 60. Carburetors 84 are interposed between the intake manifold 82 and the intake runners 85 to supply fuel as well as air into the air intake passages 82. The carburetors 84 have throttle valves (not shown) therein. A fuel supply tank is located on the associated watercraft and the carburetors 84 are connected to the fuel supply tank. A fuel pump 89 is provided on the cylinder head assembly 58. Fuel is thus supplied to the carburetors 84 by the fuel pump 89 to be mingled with air therein in a manner that is well known in the art. The air fuel charge made in the carburetors 84 will be introduced into the combustion chambers 60.

The exhaust system 78 is arranged to discharge exhaust products or gasses from the combustion chambers 60 out of the outboard motor 30. Exhaust ports 92 are formed in the cylinder head member 59 and can be opened or closed by exhaust valves 94. The exhaust ports 92 are connected to an exhaust manifold 96 disposed within the cylinder body 50. When the exhaust ports 92 are opened, the combustion chambers 60 communicate with the exhaust manifold 96 which leads the exhaust gasses to the reminder of the exhaust system 78 disposed in the driveshaft housing 40.

A single camshaft 100 extends generally vertically and is journaled on the cylinder head member 59 to activate both of the intake valves 88 and exhaust valves 94. Thus, the engine 32 is SOHC type. The camshaft 100 is driven by the crankshaft 66 in timed relationship therewith. As seen in FIG. 4, the camshaft 100 has cam lobes 102 thereon. Intake rocker arms 104 and exhaust rocker arms 106 are mounted on an intake rocker arm shaft 108 and an exhaust rocker arm shaft 110, respectively, which are journaled on the cylinder head member 59. The rocker arms 104, 106 are interposed between the camshaft 100 and the respective valves 88, 94 to open or close them at a certain timing with the rotation of the camshaft 100, in other words, in timed sequence with the angular position of the crankshaft 66. A cylinder head cover member 112 completes the cylinder head assembly 58. The cylinder head cover member 112 is affixed to the cylinder head member 59 to define a camshaft chamber 114 therebetween that encloses the camshaft 100, rocker arms 104, 106, rocker arm shafts 108, 109 and other relating components. The fuel pump 89 is mounted on the cylinder head cover member 112.

As best seen in FIG. 3, the camshaft 100 is driven by the crankshaft 66. The camshaft 100 has a cogged pulley 118 thereon, while the crankshaft 66 also has a cogged pulley 120 thereon. A cogged or timing belt 122 is wound around the cogged pulleys 118, 120. With rotation of the crankshaft 66, therefore, the camshaft 100 rotates also. This valve driving system will be described again shortly.

The engine 32 further includes a firing system. The firing system has ignition coils 130, which generate high voltage, and spark plugs 132. The spark plugs 132 are affixed on the cylinder head member 59 and exposed into the respective combustion chambers 60. The spark plugs 132 fire air fuel charges in the combustion chambers 60 at certain firing timings. A flywheel assembly 140 is affixed atop of the crankshaft 66. The flywheel assembly 140 includes a generator to supply electric power to the firing system and other electrical equipment. The engine 32, additionally, has an electrical equipment box 141 which incorporates a control unit, relays and all or some of the other electrical equipment.

Figure 2:
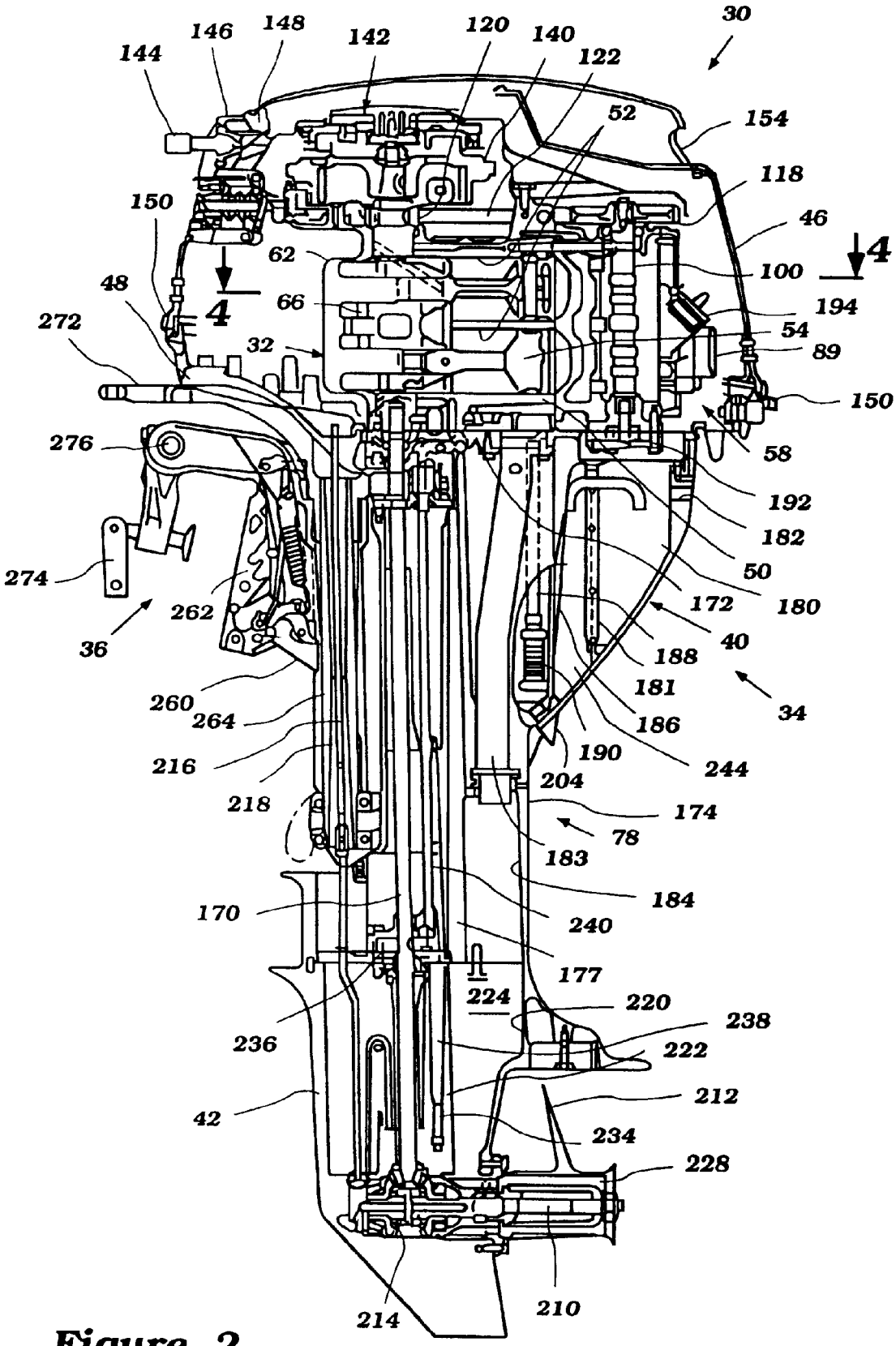
FIG. 2 is a cross-sectional, side elevational view showing the outboard motor of FIG. 1.

As seen in FIG. 2, a recoil starter assembly 142 is provided on the engine 32. This recoil starter assembly 142 includes a rope (not shown). The rope is initially wound around the crankshaft 66 and may return into this wound condition unless pulled. A starter lever 144 is connected with the rope and exposed out of the top cowling 46 so that the operator can pull outwardly. The starter lever 144 is supported by a holder portion 146 which extends from the engine 32. The holder portion 146, in turn, faces an opening formed in the top cowling 46 and a seal member 148 is provided to seal the reminder space of the holder 146 in the opening. When the operator pulls the starter lever 144, the rope is actuated to rotate the crankshaft 66. The engine 32, thus, can be manually started.

The top cowling 46 and the bottom cowling 48 generally completely enclose the engine 32 to protect it. The top cowling 46 is detachably affixed to the bottom cowling 48 with affixing mechanisms 150 so as to ensure access to the engine 32 for maintenance. The top cowling 46 has air inlet openings 154 at its rear upper portion to intake air into air compartments (not shown) formed in the top cowling 46. The air in the compartments is then goes into the interior of the cowling 46 through air inlet barrels 156 which are indicated with dotted lines in FIG. 3 and flows toward the air intake chamber 80. The flow of the air is indicated with the arrows 158. The air is, then, introduced into the air induction system 76 through the air intake chamber 80.

The driveshaft housing 40 depends from the power head 39 and supports the engine 32 and a driveshaft 170 which is driven by the crankshaft 66. The driveshaft housing 40 comprises an exhaust guide member 172 and a housing member 174. The exhaust guide member 172 is placed atop of these three members. The engine 32 is mounted on the exhaust guide member 132. The bottom cowling 48 is affixed to the exhaust guide member 172 also. The exhaust guide member 172 includes an exhaust guide section that communicates with the exhaust manifold 94.

The housing member 174 is placed between the exhaust guide member 172 and the lower unit 42. The driveshaft 170 extends generally vertically through the exhaust guide member 172 and housing member 174 and then down to the lower unit 42.

An idle exhaust expansion chamber 180 is defined in the housing member 174 of the driveshaft housing 40. Actually, a rear portion of the housing member 174 is divided into two chambers with a partition 181 and a rear chamber forms the idle expansion chamber 180. The idle expansion chamber 180 has a discharge port 182 at its rear end and exhaust gasses at idle speed are discharged to the environmental atmosphere through the discharge port 182. Since the idle exhaust gasses are expanded in the idle expansion chamber 180, exhaust noise at the idle speed is sufficiently reduced.

An exhaust pipe 183 depends from the exhaust guide member 172 into the housing member 174 of the driveshaft housing 40. The majority of exhaust gasses are sent to an exhaust cavity 184 defined within the housing member 174 of the driveshaft housing 40 through the exhaust pipe 183. The exhaust cavity 184 is formed at a rear portion of the housing member 174 by its shell and a partition wall 177 extending generally vertically almost throughout the driveshaft housing 40.

A lubricant reservoir 186 is defined between the exhaust guide member 172 and the housing member 174. The lubricant reservoir 186 has a ring configuration at its horizontal cross-section. The exhaust pipe 183 passes through this ring configuration. The lubricant reservoir 186 includes a lubricant supply pipe 188 extending upwardly from a bridge portion of the reservoir 186. An oil filter or strainer 190 covers an inlet opening of the supply pipe 188 to strain lubricant that will be introduced into the supply pipe 188. The lubricant supply pipe 188 is connected to an oil pump 192 which is affixed to the lower end of the camshaft 100 to be driven thereby. The oil pump 192 supplies the lubricant to certain sections in the engine 32 that needs lubrication. The lubricant can be replenished through a lubricant refilling port which is located on the cylinder head cover member 112 and usually closed with a cap 194. An oil filter or strainer container 198 is mounted on one side of the cylinder block 50. The container 198 incorporates an oil strainer and hence the lubricant circulating in the engine 32 is filtered by the oil strainer therein. A breather chamber or oil separator 200 (see FIG. 3) is affixed to the engine 32 and connected to the lubricant reservoir 186 and also the air intake chamber 80 through a breather hose 202. The breather chamber 200 is provided primarily for adjusting pressure in the lubricant reservoir 186 to the atmospheric pressure. A drain is provided at the bottom of the lubricant reservoir 186 and is plugged with a plug member 204.

When the oil pump 192 is driven by the camshaft 100, the lubricant in the lubricant reservoir 186 is drawn up through the lubricant supply pipe 188 to the oil pump 192 and then delivered to the engine portions that require to be lubricated through certain oil passages. After lubrication, the lubricant returns to the lubricant reservoir 186 by its own weight through return passages which are not shown.

The lower unit 42 depends from the driveshaft housing 40 and supports a propeller shaft 210 which is driven by the driveshaft 170. The propeller shaft 210 extends generally horizontally through the lower unit 42. In the illustrated embodiment, the propulsion device includes a propeller 212 that is affixed to an outer end of the propeller shaft 210 and driven thereby. A transmission 214 is provided between the driveshaft 170 and the propeller 212. The transmission 214 couples together the two shafts 170, 212 which lie generally normal to each other (i.e., at a 90° shaft angle) with, for example, a bevel gear combination. The transmission 214 has a switchover mechanism to shift rotational directions of the propeller 212 to forward, neutral or reverse. The switchover mechanism includes dog clutches disposed in the lower unit 42, a shift cable disposed in the bottom cowling 48. A shift rod 216 is also included in the switchover mechanism and extends generally vertically through a steering shaft 218 which is affixed to the driveshaft housing 40 by upper and lower mount members at a forward portion of the driveshaft housing 40. The shift rod 216 connects the dog clutch with the shift cable. The shift cable extends forwardly from the bottom cowlings 48 so as to be operated by the operator.

The lower unit 42 defines another exhaust cavity 220 with its housing shell and a partition wall 222. This exhaust cavity 220 and the aforenoted exhaust cavity 184 in the housing member 174 of the driveshaft housing 40 define an exhaust expansion chamber 224. At engine speed above idle, the majority of the exhaust gasses are expanded in this expansion chamber 224 so that exhaust noise is reduced. The exhaust gasses are, then, finally discharged to the body of water surrounding the outboard motor 30 through a hub portion 228 of the propeller 212.

The outboard motor 30 includes an engine cooling system further. The cooling system includes a water inlet port 234 disposed in the lower unit 42 and a water pump 236 disposed at the bottom of the driveshaft housing 40. The water pump 236 is mounted on the driveshaft 170 to be driven thereby. Cooling water is introduced into a water inlet conduit 238 from the body of water surrounding the outboard motor 30 through the water inlet port 234 and supplied to water jackets 242 in the engine 32 through the water pump 236 and a water supply conduit 240 by the operation of the water pump 236. The water that has cooled the engine portions will be discharged outside through certain passages. The exhaust system 78 and the lubricant reservoir 186 accumulate much heat in nature. Some part of the water is, thus, used for cooling these components. For instance, a front chamber 244 which is defined in the housing member 174 in front of the aforenoted partition 181 can collect such water to cool down primarily the lubricant reservoir 186.

The bracket assembly 36 comprises a swivel bracket 260 and a clamping bracket 262. The swivel bracket 260 supports the drive unit 34 for pivotal movement about a generally vertically extending steering axis which is an axis of the steering shaft 218 that is affixed to the driveshaft housing 40. The steering shaft 218 extends through a steering shaft housing 264 of the swivel bracket 260. The steering shaft 218 is affixed to the driveshaft housing 40 by an upper mount assembly 266 (see FIG. 1) and a lower mount assembly 268.

A steering bracket 272 extends generally upwardly and then forwardly from the steering shaft 218. A steering handle (not shown) is affixed onto the steering bracket 272. The operator can steer the outboard motor 30 with the steering handle. A throttle control lever may be also attached to the steering handle. Throttle opening of the throttle valves in the carburetors 84 are remotely controlled by the throttle control lever.

The clamping bracket 262, in turn, will be affixed to the transom of the associated watercraft with an affixing member 274 and supports the swivel bracket 260 for pivotal movement about a generally horizontally extending tilt axis, i.e., the axis of a pivot shaft 276. The clamping bracket 262 includes a pair of members spaced apart laterally with each other. A thrust pin is transversely provided between the spaced members. A lower front portion of the swivel bracket 260 contacts the thrust pin and conveys thrust force by the propeller 212 to the associated watercraft.

As used through this description, the terms "forward," "front," and "forwardly" mean at or to the side where the clamping bracket 262 is located, and the terms "rear," "reverse," and "rearwardly" mean at or to the opposite side of the front side, unless indicated otherwise.

Although a hydraulic tilt system can be provided between the swivel bracket 260 and the clamping bracket 262, this exemplary outboard motor 30 has no such system. The operator, therefore, tilt it up or down by himself or herself. When the operator wants to hold the outboard motor 30 at the tilted up position, he or she may use a tilt pin (not shown) in a manner which is well known in the art.

With reference again to FIGS. 4 and 5 and additionally to FIGS. 6 to 9, the engine 32 and particularly a pair of decompression devices 290 will now be described in detail. As described above, the intake valves 88 and exhaust valves 94 are provided for opening and closing the intake ports 86 and exhaust ports 92, respectively. The single camshaft 100 has, the intake cam lobes 102*a* and exhaust cam lobes 102*b*. The intake and exhaust valves 88, 94 are biased by coil springs 292 toward their closed positions unless the rocker arms 104, 106 push the valves 88, 94 down against the biasing force of the springs 292. The rocker arms 104, 106 are levers journaled on the rocker arm shafts 108, 110 and include valve actuating ends 294 which contact the valves 88, 94 at their end portions and follower portions 296 which contact the camshaft 100. The follower portions 296 extend oppositely relative to the valve actuating ends 294. The valve actuating ends 294 can accordingly push the valves 88, 94 when the cam lobes 102*a*, 102*b* meet the follower portions 296 to push them up. Thus, the respective intake and exhaust valves 88, 94 are opened periodically by the actions of the rocker arms 104, 106 during regular running operations of the engine 32.

During at least a portion of each compression stroke of the engine 32 when the engine is running, both of the intake and exhaust valves 88, 94 are not opened because the combustion chambers 60 must be completely closed in order to achieve the desired compression the air/fuel charge. When starting the engine 32, however, the pressure produced by the compressed air in the combustion chambers 60 will make it difficult for the operator to pull the rope of the recoil starter 142. It is therefore desirably to reduce the compression ratio to ease manual starting. One or more decompression devices 290 are provided for reducing the compression ratio in one or more of the cylinders when starting the engine.

Figure 5:
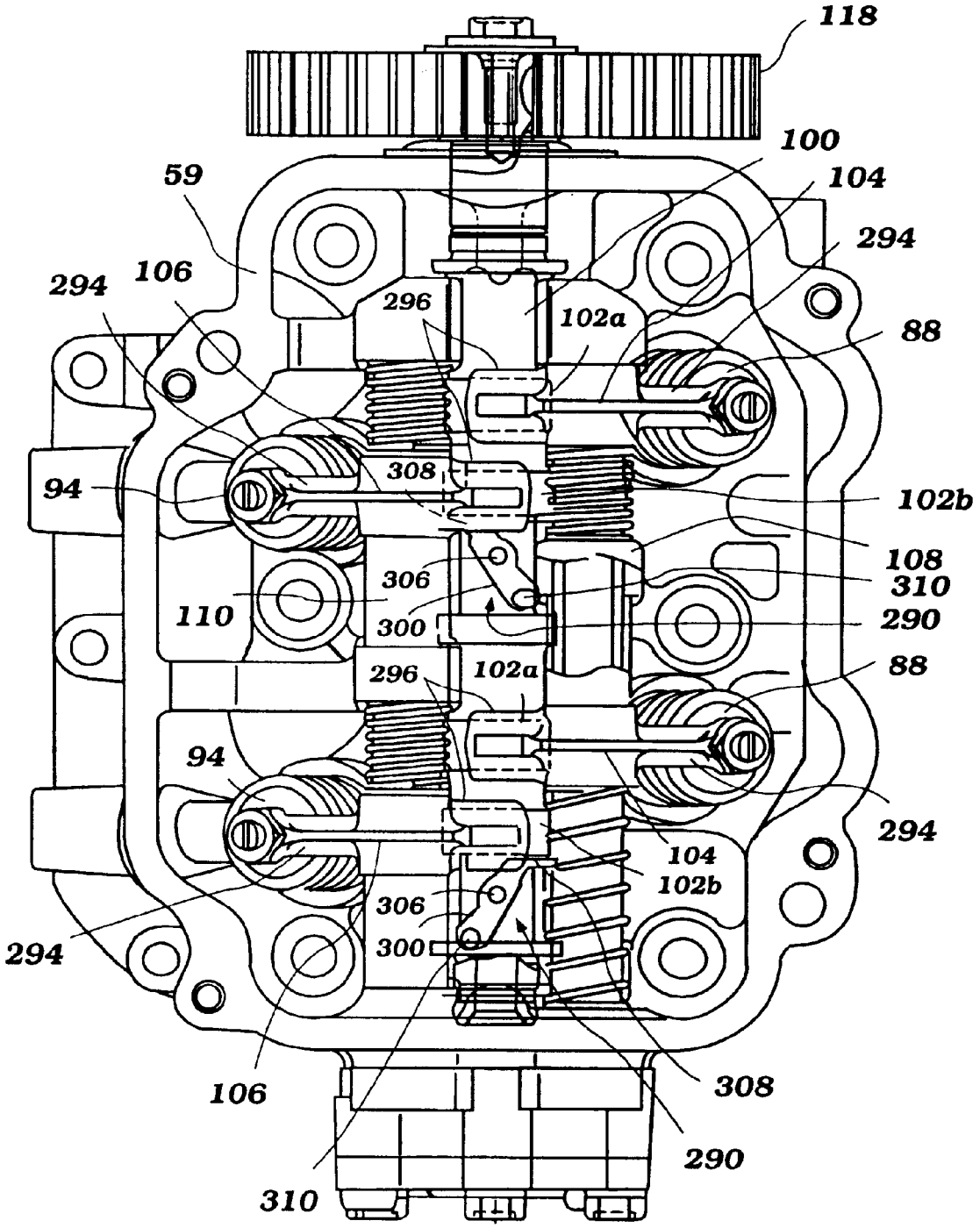
FIG. 5 is a rear view looking generally in the direction of the arrow 5 and below the line 5L—5L in FIG. 4 with a cylinder head cover and the components mounted thereon removed to show a camshaft and valve arrangement including the decompression devices.

In the illustrated embodiment, the decompression devices 290 are arranged to open the exhaust valves 94. As seen in FIG. 5, the cam lobes 102*a* for the intake valves 104 and the cam lobes 102*b* for the exhaust valves 106 at each cylinder bore 52 are lined vertically in proximity to each other and the respective intake cam lobes 102*a* are positioned above the respective exhaust cam lobes 102*b*. Since spaces are available below the respective cam lobes 102*b* for the exhaust valves 94 on the camshaft 100 in this arrangement, each decompression device 290 is positioned at each one of these spaces.

Figure 6:
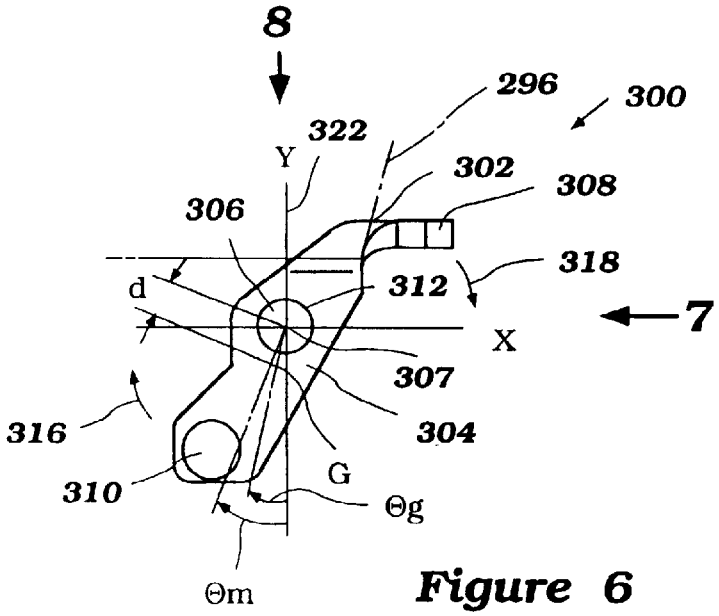
FIG. 6 is a rear view showing an actuator of the decompression device.
Figure 7:
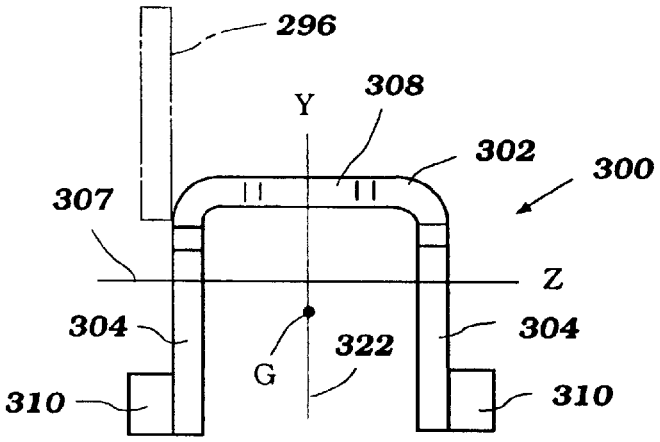
FIG. 7 is a side view looking generally in the direction of the arrow 7 in FIG. 6 to show the same actuator.
Figure 8:
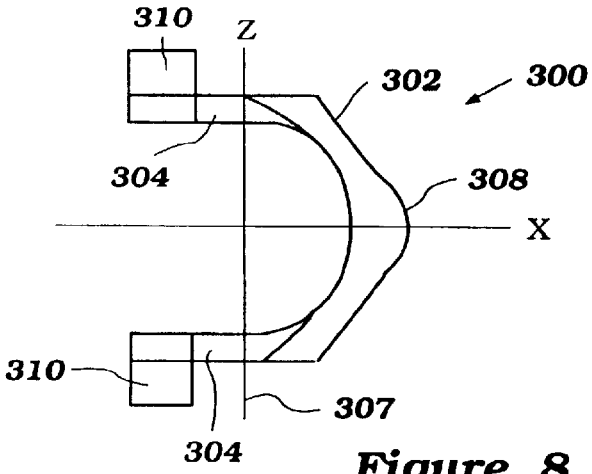
FIG. 8 is a top plan view looking generally in the direction of the arrow 8 in FIG. 6 to show the same actuator.

Each decompression device 290 includes an actuator 300 which has a configuration shown in FIGS. 6 to 8. In order to aid the description of this component, the actuator 300 is illustrated in these figures with reference to a three dimensional coordinate system which include X, Y and Z axes as shown in FIGS. 6 to 8. The Z axis corresponds to a pivot axis of the actuator. The Y axis generally extends normal to the Z axis and parallel to an axis about which the actuator is designed to rotate with the camshaft. The X axis lies normal to the Y and Z axes.

The actuator 300 is shaped generally as the letter U in both of side and top plan views. The actuator 300 has a bridge portion 302 which corresponds to the bottom of the letter U and a pair of side portions 304 which extend from the bridge portion 302. The bridge portion 302 generally defines a first section, while the side portions 304 generally define a second section.

The actuators 300 have pivot shafts 306 which axis 307 extend horizontally and coincide with the axis Z as shown in FIGS. 7 and 8. In the illustrated embodiment, the pivot axis 307 intersects with the rotational axis of the camshaft 100. The bridge portion 302 has a cam lobe 308 that is positioned at the center of the bridge portion 302 and on the axes X and Y. The respective side portions 304 are positioned at equal distances from the axes X and Y and have weights or sinkers 310 at each end. Each actuator 300 is mounted on the camshaft 100 for pivotal movement about the axis 307 as that the bridge portion 302 and side portions 304 straddle (i.e., sit astride) the camshaft 100. The sinkers 310 are positioned opposite the bridge portions 302 relative to the pivot axis 307. As the actuator 300 is mounted in such a manner, the axis 307 extends normal to (and possibly intersects with) an axis of the camshaft 100.

When the camshaft 100 stands still or is driven by the crankshaft 66 at an engine speed greater than a predetermined speed, the bridge portions 302 are positioned under the follower portions 296 of the rocker arms 104 or engaged with them because the sinkers 310 are pulled down by gravity. This is, therefore, an initial position of the actuator 300. The cam lobes 308 of the bridge portions 302 under this condition can push the follower portions 296 of the rocker arms 106 upwardly and hence the end portions of the valve actuating ends 294, in turn, push the exhaust valves 94 down to open the exhaust ports 92. When, the camshaft 100 is driven at an engine speed that exceeds the predetermined speed, the sinkers 310 are swung generally upwardly, as indicated with the arrow 316 shown in FIG. 6, by centrifugal force and accordingly the bridge portions 302 are conversely moved downwardly and outward, as indicated with the arrow 318 shown also in FIG. 6, to put the cam lobes 308 out of engagement with the follower portions 296 of the rocker arms 106. An angular position of each pivot axis 307 is determined so that the cam lobe 308 of the actuator 300 can be snuggled under the follower portions 296 at least during a portion of the compression stroke of the engine 32 when the camshaft 100 rotates. The aforenoted second sections of the actuators 300 which include the sinkers 310 are positioned lower than the pivot axes 307 at least when the camshaft 100 is not driven.

The lower the predetermined speed can be selected, the earlier the cam lobes 308 may be released from the initial position (i.e., positioned under to follower portions 296 of the rocker arms 106). The positions and weight of the sinkers 310 on each actuator 300 are preferably selected so that the center of gravity G (see FIGS. 6 and 7) of the actuator 300 is positioned as follows:

$$m*d>M$$

m: weight of the actuator 300;

d: distance between the pivot axis 307 and the center of gravity G;

m*d: rotational moment;

M: the minimum moment that is necessary for the actuator 300 returning to the initial position at which the bridge portion 302 is laid under the follower portion 296 by its own weight and;

$$\theta_g<\theta_m$$

$\theta_g$: displacement angle made between a line extending through the center of gravity G from the pivot axis 307 and a perpendicular line 322 which coincides with the axis Y in FIGS. 6 and 7;

$\theta_m$: marginal angle corresponds to a maximum angle at which the center of gravity G can be moved away from the perpendicular line 322 along the arc defined by distance d and still have the actuator release from the initial position at a predetermined minimum rotational speed of the camshaft.

Figure 9:
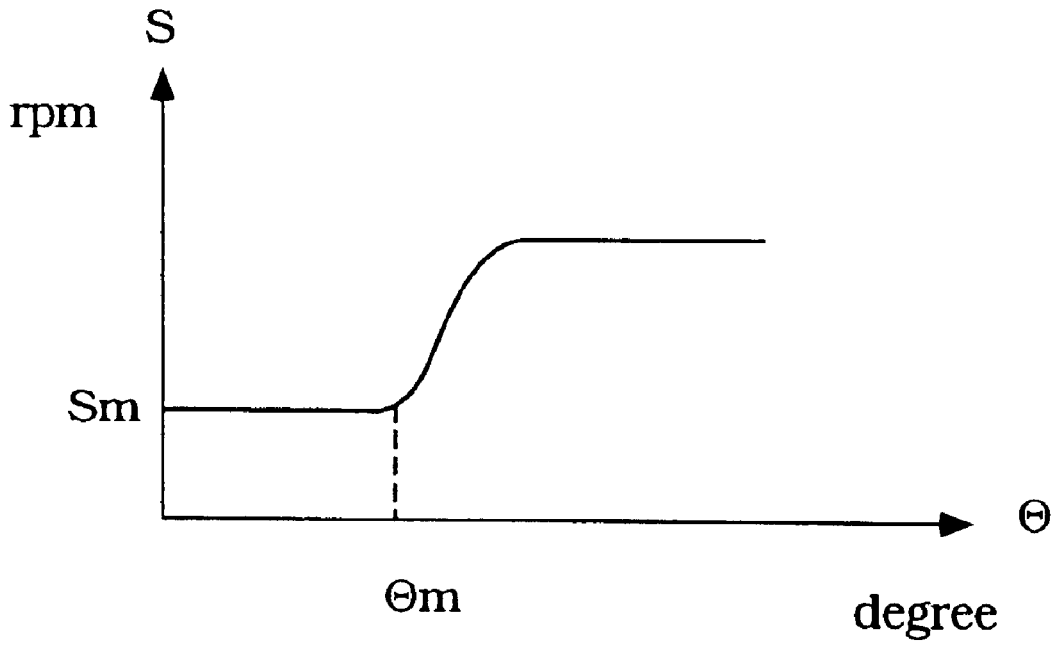
FIG. 9 is a graph showing a relationship between engine speed and the center of gravity's displacement angle on the actuator, which is the angle at which the center of gravity lies away from a datum line (e.g., the Y axis in FIG. 6) along an arc defined by a distance d. The graph illustrates a marginal angle $\theta_m$ that corresponds to a maximum displacement angle at which the center of gravity can be moved away from the datum line along the arc defined by distance d and still have the actuator release from the initial position (i.e., the engaged position) at a minimum rotational speed.

FIG. 9 graphically illustrates the relationship between an angle θ and an engine speed S at which the actuator 300 can be released from the initial position. This relationship has been obtained empirically. The angle θ corresponds to an angle at which the center of gravity lies away from the perpendicular line 322 along an arc defined by distance d.

As seen in this figure, the engine speed S remains at the minimum speed $S_m$ when the angle θ is kept less than the marginal angle $\theta_m$. If, however, this angle exceeds the marginal angle $\theta_m$, the engine speed S abruptly increase and then plateaus at another speed that is greater than the speed $S_m$. This means that if the angle θ is smaller than the marginal angle $\theta_m$, the actuator 300 can be released from the initial position at the minimum engine speed $S_m$.

For instance, in an outboard motor, if the engine speed under a trolling condition is 600 rpm and the aimed or predetermined engine speed, at which the actuator 300 is to release from the follower portions 296 of the rocker arms 106, is 450 rpm, the marginal angle $\theta_m$ will be 25° or around 25°. Thus, if the center of gravity G of the actuator 300 is positioned at a place where a rotational moment of the actuator 300 is greater than the minimum moment thereof that is necessary for the actuator 300 to return to the initial position at which the bridge portion 302 is moved under the follower portion 296 by its own weight, and the angle $\theta_g$ of the center of gravity G of the actuator 300 is smaller than about 25°, the actuator 300 can be released in the minimum engine speed of 450 rpm without any problems in operation of the actuator 300. Incidentally, the engine speed under this trolling condition equals an idle speed of the engine because the transmission the switchover mechanism shifts the rotational direction of the propeller 212 to the forward position and the engine runs in the idle speed under this condition.

As described above, the decompression device in accordance with the embodiment of the present invention can be released at an exceedingly slow engine speed and weight and positions of sinkers are relatively easily selected through routine experimentation.

In the illustrated embodiment, the exhaust valves are positioned below the intake valves. However, the contrary arrangement is also applicable. The point of the present invention is that the sinkers of the actuator are positioned lower than the pivot axis when the camshaft stands still or is not driven by the crankshaft.

As is apparent from the above descriptions, the exhaust rocker arms in the illustrated embodiment are members of the decompression devices because they are involved to hold the exhaust valves open during a starting operation. However, if the engine is DOHC (Double Over Head Camshaft) type, no rocker arms are employed and hence cam lobes of decompression actuators directly hold exhaust valves.

Also, the decompression actuator can be applicable with the intake valves instead of the exhaust valves. Additionally, the present decompression actuator can be employed on engines having other orientations. For example, the camshaft can extend in a generally horizontal direction with the sinkers positioned above the rotational axis of the camshaft and the cam lobe positioned below the rotational axis of the camshaft.

Of course, the foregoing description is that of preferred embodiments of the invention, and various changes and modifications may be made without departing from the spirit and scope of the invention, as defined by the appended claims.

What is claimed is:

1. An internal combustion engine comprising a cylinder block defining at least one cylinder bore therein, a crankshaft journaled for rotation relative to said cylinder block at one end of said cylinder bore and driven by a piston reciprocating in said cylinder bore, a cylinder head closing an opposite end of said cylinder bore and defining a combustion chamber with said piston and said cylinder bore, an intake passage communicating with said combustion chamber through an intake valve port, an intake valve configured to open and close said intake valve port, an exhaust passage extending from an exhaust port in said combustion chamber to discharge exhaust products from said combustion chamber, an exhaust valve configured to open and close said exhaust port, a camshaft rotating about a camshaft axis and being driven in timed relationship with said crankshaft to actuate at least one of said intake valve and said exhaust valve, and a decompression device to at least partially open one of said intake valve and said exhaust valve at least during a portion of a compression stroke to reduce a compression ratio of said combustion chamber to ease starting of said engine, said decompression device comprising an actuator mounted on said camshaft for pivotal movement about an actuator pivot axis extending generally normal to said camshaft axis, said actuator having a first section and a second section disposed opposite said first section relative to said actuator pivot axis, said actuator being made of a thin material, said second section comprising a pair of side portions, said first section comprising a bridge portion coupling together said side portions, said bridge portion comprising a cam lobe configured to hold said intake valve or said exhaust valve at least partially open when said actuator is placed at an initial position, said bridge portion having a surface, said cam lobe extending generally flush with said surface, said actuator being configured such that its center of gravity is located a distance d from said actuator pivot axis such that a rotational moment of said actuator is greater than a minimum moment that returns said actuator to said initial position under said actuator's own weight, and said center of gravity when said actuator is in said initial position also is located relative to said actuator pivot axis such that a displacement angle θg is generally less than a marginal angle θm, wherein said displacement angle θg is defined between a line that extends through said actuator pivot axis and said center of gravity and a datum line that extends through said actuator pivot axis and lies generally parallel to said camshaft axis, an arc being defined by said distance d from said actuator pivot axis, and said marginal angle θm corresponds to a maximum angle at which said center of gravity can be moved away from said datum line along said arc and still have said actuator release from said initial position at a predetermined minimum rotational speed of said camshaft.

2. An internal combustion engine as set forth in claim 1, wherein said engine further comprises at least one rocker arm driven by said camshaft to actuate at least one of said exhaust valve and said intake valve, and said first section of said actuator is configured to position said rocker arm at an orientation holding said exhaust valve or said intake valve in said at least partially open position.

3. An internal combustion engine as set forth in claim 2, wherein said actuator has generally a U-shape.

4. An internal combustion engine as set forth in claim 3, wherein said actuator is mounted on said camshaft along a portion of said side portions for pivotal movement relative to said actuator pivot axis.

5. An internal combustion engine as set forth in claim 4, wherein said side portions comprise sinkers.

6. An internal combustion engine as set forth in claim 5, wherein said sinkers are positioned generally at respective ends of said side portions opposite said bridge portion.

7. An internal combustion engine as set forth in claim 4, wherein said actuator is disposed on said camshaft such that said actuator pivot axis generally intersects with said camshaft axis.

8. An internal combustion engine as set forth in claim 1, wherein said second section comprises at least one sinker.

9. An internal combustion engine as set forth in claim 8, wherein said sinker is positioned on said actuator relative to said actuator pivot axis so as to bias said actuator toward said initial position when said camshaft is not rotating.

10. An internal combustion engine as set forth in claim 1, wherein said marginal angle θm is about 25 degrees.

11. An internal combustion engine as set forth in claim 1, wherein said actuator opens said exhaust valve.

12. An internal combustion engine as set forth in claim 11, wherein said camshaft extends in generally a vertical direction and said exhaust valve is positioned generally above said actuator pivot axis.

13. An internal combustion engine as set forth in claim 12, wherein said intake valve is positioned above said exhaust valve.

14. An internal combustion engine as set forth in claim 1, wherein said engine operates on a four stroke principle.

15. An internal combustion engine as set forth in claim 1, wherein said engine powers a marine propulsion device.

16. An engine comprising a camshaft being rotatable about a camshaft axis and being adapted to operate at least one intake valve or exhaust valve, said engine also comprising a decompression device comprising an actuator mounted on said camshaft for pivotal movement about an actuator pivot axis extending generally normal to said camshaft axis, said actuator comprising a cam section that holds said at least one intake valve or exhaust valve in an at least partially open position and a sinker section that moves with centrifugal force produced by rotation of said camshaft so as to release said cam section from holding said intake or exhaust valve at least partially open, said cam section being disposed on one side of said actuator relative to said actuator pivot axis and said sinker section being disposed on an opposite side of said actuator relative to said actuator pivot axis, said actuator being configured with a center of gravity that lies to a same side of said actuator pivot axis as does said sinker section, said actuator being made of a thin material, said sinker section comprising a pair of side portions, said cam section comprising a bridge portion coupling together said side portions, said bridge portion comprising a surface and a cam lobe adapted to hold said intake valve or exhaust valve in said at least partially open position, said cam lobe being formed generally flush with said surface.

17. An engine as in claim 16, wherein said actuator is configured such that said center of gravity is located a sufficient distance d from said actuator pivot axis such that a rotational moment of said actuator is greater than a minimum moment necessary for said actuator to return to said initial position under its own weight.

18. An engine as in claim 16, wherein said actuator is configured such that said center of gravity when said actuator is in said initial position also is located relative to said actuator pivot axis such that a displacement angle θg is generally less than a marginal angle θm, said displacement angle θg being defined between a line that extends through said actuator pivot axis and said center of gravity and a datum line that extends through said actuator pivot axis and lies generally parallel to said camshaft axis, an arc being defined by said distance d from said actuator pivot axis, and said marginal angle θm corresponding to a maximum angle at which said center of gravity can be moved away from said datum line along said arc and still have said actuator release from said initial position at a minimum rotational speed of said camshaft.

19. An engine as in claim 18, wherein said cam section has a thickness which corresponds to an original thickness of said sheet metal, said cam lobe has a surface extending generally in a direction of said thickness, and said cam section holds said intake or exhaust valve at said surface of said cam lobe.

20. An engine comprising a camshaft for activating at least one intake or exhaust valve, said camshaft being rotatable about a camshaft axis, and a decompression device comprising an actuator mounted on said camshaft for pivotal movement about a pivot axis extending generally normal to said camshaft axis, said actuator including a cam section that holds said intake or exhaust valve in at least a partially open position and a sinker section that moves with centrifugal force produced by rotation of said camshaft so as to release said cam section from holding said intake or exhaust valve at least partially open, said cam section being disposed on one side of said actuator relative to said pivot axis and said sinker section being disposed on an opposite side of said actuator relative to said pivot axis, said actuator being made of a thin material, said sinker section including a pair of side portions, said cam section including a bridge portion coupling together said side portions, said bridge portion having a cam lobe at which said cam section holds said intake or exhaust valve, said cam lobe extending straight from said bridge portion without being bent, said cam section having a thickness which corresponds to an original thickness of said thin material, said cam lobe having a surface extending generally in a direction of said thickness, and said cam section holding said intake or exhaust valve at said surface of said cam lobe.

21. An engine comprising a generally vertically extending crankshaft, a generally vertically extending camshaft, said crankshaft connected to said camshaft and arranged to drive said camshaft about a camshaft axis in a timed manner, said camshaft comprising a cam lobe, said engine further comprising a flow control valve adapted to control flow into or out of a combustion chamber, said camshaft cam lobe intermittently opening said valve through contact with a valve actuating assembly, said engine also comprising a decompression arrangement, said arrangement comprising an actuator, said actuator being pivotally coupled to said camshaft and being capable of pivotal movement about an actuator axis that is generally normal to said camshaft axis, said actuator comprising a contact portion that at least partially opens said valve during a period in which said camshaft cam lobe is not in contact with said valve actuating assembly, said contact portion comprising a bridge, at least a portion of a pair of side members and an actuator cam lobe, said bridge comprising an end surface and an upper surface, said actuator cam lobe extending from said end surface and is substantially flush with said upper surface, said actuator also comprising an increased mass portion and a plane being defined generally along said camshaft axis and through said actuator axis, said increased mass portion being positioned to a first side of said plane and said contact portion being positioned to a second side of said plane that is opposite of said first side when said contact portion is in registry with said valve actuating assembly.

22. The engine of claim 21, wherein said increased mass portion is positioned to said first side of said plane, and said contact portion is positioned to said second side of said plane also when said contact portion is not in registry with said valve actuating assembly.

23. The engine of claim 22, wherein said actuator axis is generally vertically lower than said contact portion.

24. The engine of claim 21, wherein said increased mass portion is positioned along another portion of said pair of side members.

25. The engine of claim 24, wherein said increased mass portion comprises a pair of sinkers that are mounted to lower ends of said pair of side members.

26. The engine of claim 21, wherein said edge surface is disposed on a first side of said bridge and said cam shaft is disposed on a second side of said bridge that is generally opposite to said first side.

27. The engine of claim 21, wherein said actuator is formed of a thin material.

28. An engine comprising a generally vertically extending crankshaft, a generally vertically extending camshaft, said crankshaft connected to said camshaft and arranged to drive said camshaft about a camshaft axis in a timed manner, said camshaft comprising a cam lobe, said engine further comprising a flow control valve adapted to control flow into or out of a combustion chamber, said camshaft cam lobe intermittently opening said valve through contact with a valve actuating assembly, said engine also comprising a decompression arrangement, said arrangement comprising an actuator, said actuator being pivotally coupled to said camshaft and being capable of pivotal movement about an actuator axis that is generally normal to said camshaft axis, a first plane being defined generally normal to said camshaft and extending through said actuator axis, said actuator comprising a contact portion that at least partially opens said valve during a period in which said camshaft cam lobe is not in contact with said valve actuating assembly, said contact portion comprising an actuator cam lobe, a bridge and at least a portion of a pair of side members, said bridge comprising an end surface and an upper surface, said actuator cam lobe extending from said end surface and is substantially flush with said upper surface, a second plane being defined generally normal to said camshaft and extending through said cam lobe, said actuator also comprising an increased mass portion, a third plane being defined generally normal to said camshaft and extending through said increased mass portion, said first plane being interposed between said second plane and said third plane when said actuator cam lobe is in registry with said valve actuating assembly.

29. The engine of claim 28, wherein said actuator axis is generally vertically lower than said contact portion.

30. The engine of claim 28, wherein said increased mass portion is positioned along another portion of said pair of side members.

31. The engine of claim 30, wherein said increased mass portion comprises a pair of sinkers that are mounted to lower ends of said pair of side members.

32. The engine of claim 28, wherein said edge surface is disposed on a first side of said bridge and said cam shaft is disposed on a second side of said bridge that is generally opposite to said first side.

33. The engine of claim 28, wherein said actuator is formed of a thin material.

* * * * *